US007639570B2

(12) United States Patent
Chou et al.

(10) Patent No.: US 7,639,570 B2
(45) Date of Patent: Dec. 29, 2009

(54) ELECTRONIC DEVICE WITH AN ALARM CLOCK FUNCTION AND METHOD OF CONTROLLING THE FUNCTION

(75) Inventors: Cheng-Hao Chou, Taipei Hsien (TW); Bo-Ching Lin, Taipei Hsien (TW); Xiao-Guang Li, Shenzhen (CN); Li Wang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/185,129

(22) Filed: Aug. 4, 2008

(65) Prior Publication Data

US 2009/0086585 A1 Apr. 2, 2009

(30) Foreign Application Priority Data

Sep. 28, 2007 (CH) ..... 2007 1 0077396

(51) Int. Cl.
*G04C 21/00* (2006.01)
*G04B 23/00* (2006.01)

(52) U.S. Cl. ..... 368/74; 368/250; 368/262

(58) Field of Classification Search ..... 368/10, 368/11, 72–74, 250, 251, 262
See application file for complete search history.

(56) References Cited

U.S. PATENT DOCUMENTS

| | | | | |
|---|---|---|---|---|
| 3,834,153 | A * | 9/1974 | Yoda et al. | 368/251 |
| 4,316,273 | A * | 2/1982 | Jetter | 368/47 |
| 4,426,157 | A * | 1/1984 | Jetter | 368/73 |
| 4,430,006 | A * | 2/1984 | Jetter | 368/73 |
| 4,879,699 | A * | 11/1989 | Sakamoto | 368/63 |
| 5,095,468 | A * | 3/1992 | Sato | 368/72 |
| 5,189,648 | A * | 2/1993 | Cooper et al. | 368/73 |
| 5,926,442 | A * | 7/1999 | Sirhan et al. | 368/73 |
| 6,314,384 | B1 * | 11/2001 | Goetz | 702/177 |
| 6,975,563 | B2 * | 12/2005 | de Brito | 368/109 |
| 2003/0198137 | A1 * | 10/2003 | Gorden | 368/12 |
| 2004/0156271 | A1 * | 8/2004 | Brito | 368/109 |
| 2005/0174889 | A1 * | 8/2005 | Marcantonio et al. | 368/12 |
| 2007/0285396 | A1 * | 12/2007 | Fu | 345/169 |

* cited by examiner

*Primary Examiner*—Vit W Miska
(74) *Attorney, Agent, or Firm*—Zhigang Ma

(57) ABSTRACT

An electronic device with an alarm clock function includes a storage unit storing an alarm time, audio files and related information; an audio playing module for randomly playing an audio file via an audio output unit which matches the alarm time; an option generating module for generating and outputting preset number options, at least one of them containing the related information of the playing audio file; a comparison module for receiving inputs and determining whether the input matches the related information of the playing audio file; a managing unit for disabling the alarm clock function when the input matches the related information. A method of controlling the alarm clock function is also provided.

10 Claims, 3 Drawing Sheets

| Audio Files | Related Information |
|---|---|
| A | A1 |
| | A2 |
| | A3 |
| B | B1 |
| | B2 |
| | B3 |
| | B4 |
| C | C1 |
| | C2 |
| | C3 |
| ⋮ | ⋮ |

FIG. 2

ELECTRONIC DEVICE WITH AN ALARM CLOCK FUNCTION AND METHOD OF CONTROLLING THE FUNCTION

BACKGROUND

1. Technical Field

The present invention relates to an electronic device with an alarm clock function that can effectively wake-up a user.

2. General Background

Waking up in the morning or simply being on time is a difficult proposition for many people. It is quite common for people to use alarm clocks to wake or alert themselves at a pre-determined time. A user can press a particular or any key to turn off the alarm clock. Unfortunately, the user may inadvertently turn off the alarm when he or she is groggy from waking up. This sometimes leads to oversleeping. Moreover, the user may not realize he or she has turned off the alarm.

To counteract this problem, some people use what is commonly known as a snooze function, however people may disable this function as well without fully awakening. If the alarm clock can be turned off only when the user is clear-headed, that would be more effective.

Therefore, an alarm clock function that can wake the user up effectively is needed.

SUMMARY

An electronic device with an alarm clock function includes a storage unit storing an alarm time, audio files and related information; an audio playing module for randomly playing an audio file via an audio output unit at the alarm time; an option generating module for generating and outputting preset number options, at least one of them containing the related information of the playing audio file; a comparison module for receiving input and determining whether the input matches the related information of the playing audio file; a managing unit for disabling the alarm clock function when the input matches the related information.

Other advantages and novel features will be drawn from the following detailed description with reference to the attached drawing.

BRIEF DESCRIPTION OF THE DRAWINGS

The components of the drawings are not necessarily drawn to scale, the emphasis instead being placed upon clearly illustrating the principles of the electronic device with an alarm clock function that can effectively wake-up a user. Moreover, in the drawings, like reference numerals designate corresponding parts throughout the several views.

FIG. 2 is an exemplary block diagram of audio files with related information.

DETAILED DESCRIPTION OF THE EMBODIMENT

Figure 1:
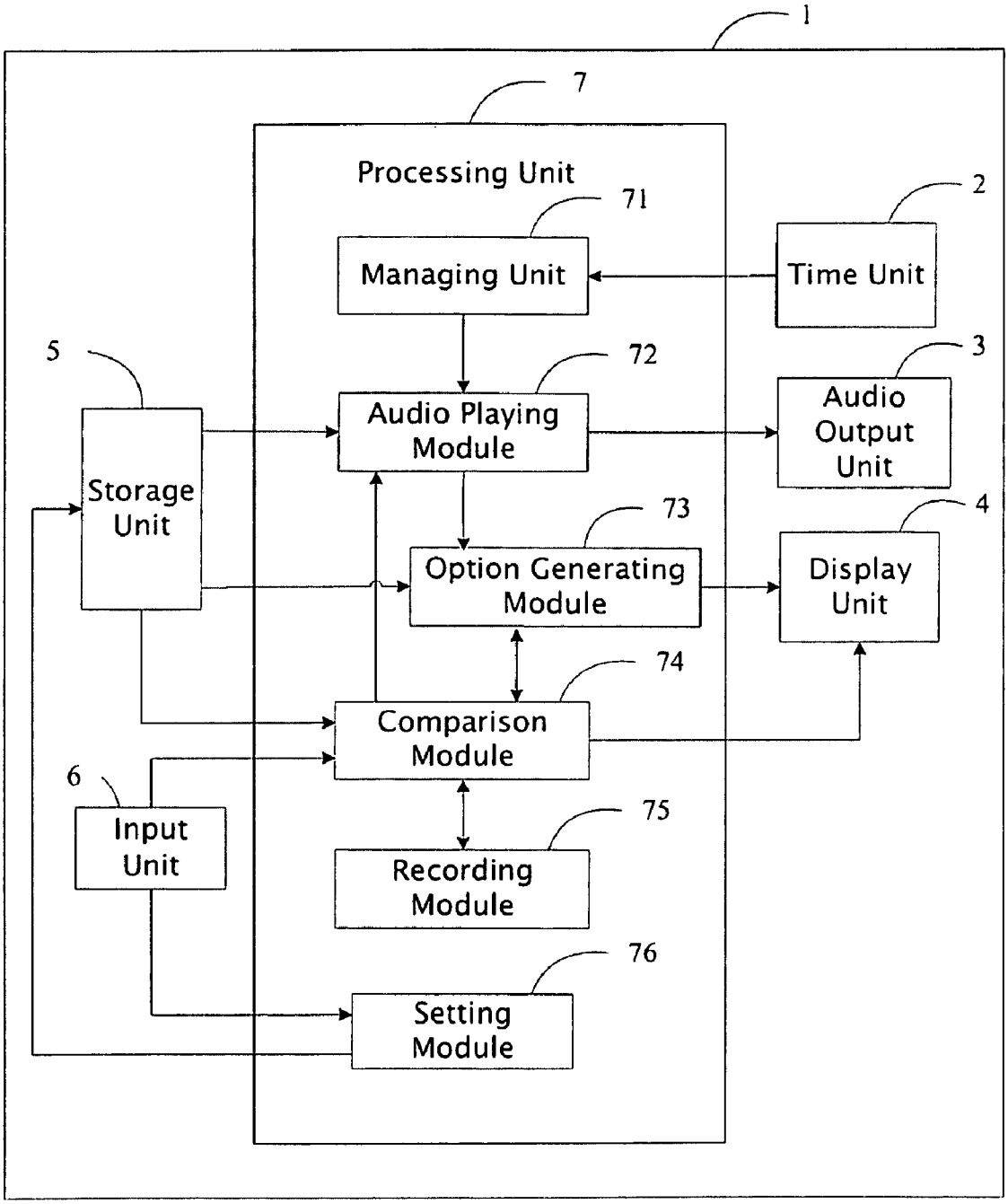
FIG. 1 is an exemplary block diagram of a hardware infrastructure of an electronic device with an alarm clock function in accordance with an exemplary embodiment of the invention.

FIG. 1 is an exemplary block diagram of a hardware infrastructure of an electronic device with an alarm clock function in accordance with an exemplary embodiment of the invention. The electronic device 1 includes a time unit 2, an audio output unit 3, a display unit 4, a storage unit 5, an input unit 6, and a processing unit 7.

The time unit 2 is used for supplying the current time. The display unit 4 and the audio output unit 3 are used for outputting images and playing audio files respectively, according to an instruction of the processing unit 100. The input unit 6 is used for receiving user input. It is configured to allow the user to select one of many options displayed by the display unit 4.

The storage unit 5 is used for storing audio files, information related to the audio files, an alarm time, alarm modes, a count number, and a preset number. The information related to the audio files includes, but is not limited to, a performer's name, a song title, and so on. The alarm modes include, but are not limited to, a ring mode and a vibration mode. The count number represents a count of a user's correct inputs. The alarm time is set by the user and indicates a time of performing an alarm clock function. The preset number indicates the number of times that the user must input a correct answer. When the count number equals the preset number, the alarm clock function is disabled.

FIG. 2 is a schematic diagram showing a table of audio files and information related to the audio files. The table has two columns. One column is for the audio files, while the other column is for information related to the audio files. For example, the information related to the audio file A includes but is not limited to, A1, A2, and A3; the information related to the audio file B includes but is not limited to, B1, B2, and B3, and the information related to the audio file C includes but is not limited to, C1, C2, and C3.

The processing unit 7 further includes a managing unit 71, an audio playing module 72, an option generating module 73, a comparison module 74, a recording module 75, a setting module 76, and a number confirming module 77.

The managing unit 71 performs the alarm clock function at a time selected by a user. The audio playing module 72 reads an audio file from the storage unit 5, and controls the audio output unit 3 to play the audio file.

The option generating module 73 generates a predetermined number of options. The options are composed of the information related to the audio files. At least one of the options corresponds to a playing audio file, while other options can randomly correspond to other audio files except the playing audio file. The option generating module 73 further sends the generated options to the display unit 4 for display.

The comparison module 74 compares user input with the information related to the playing audio file, and determines whether the user input is correct. In an exemplary embodiment of the invention, the option generating module 73 further sends an icon together with each of the generated options. When receiving inputs by the user, the comparison module 74 determines whether the answers the user inputs matches the icon.

The recording module 75 adds 1 to the count number when the user's input is correct, and determines whether the count number is equal to the preset number.

The setting module 76 sets the alarm time, the alarm mode, and the preset number, via the input unit 6, and stores these settings in the storage unit 5. However, the alarm mode and the preset number can also be pre-stored in the storage unit 5. The functions of the modules in the processing unit 7 are described below together with FIG. 3.

Figure 3:
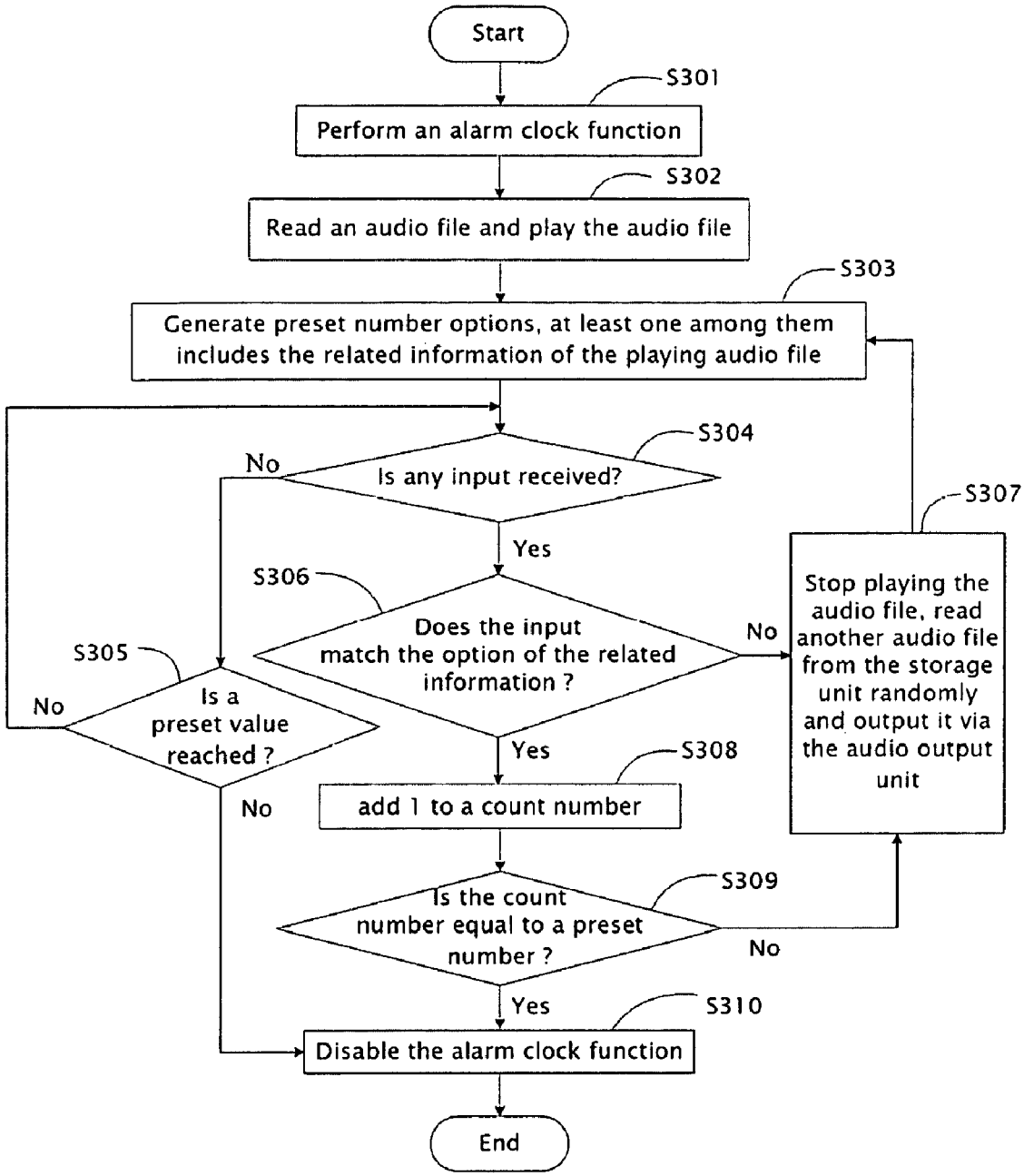
FIG. 3 is a flowchart of a method of controlling the alarm clock function of the electronic device of FIG. 1 in accordance with an exemplary embodiment of the invention.

FIG. 3 is a flowchart of a method of controlling the alarm clock function of the electronic device 1 in accordance with an exemplary embodiment.

In step S301, the managing module 71 performs the alarm clock function of the electronic device 1.

In step S302, the audio playing module 72 randomly reads an audio file from the storage unit 5 and controls the audio output module 3 to play the audio file.

In step S303, the option generating module 73 generates the predetermined number of options, and sends the options to the play unit 4.

In step S304, the input unit 6 determines whether user input is received. If user input is received from the input unit 6, the procedure goes to step 306, otherwise the procedure goes to step S305.

In step S305, the time unit 2 determines whether the duration of the alarm clock function equals a preset value. If the duration equals the preset value, the procedure goes back to step S304, otherwise the procedure goes to step S306.

In step S306, if user input is received from the input unit 6, the comparison module 74 determines whether the user input matches the option of the information related to the playing audio file. If the input matches the option of the information related to the playing audio file, the procedure goes to step S308; if the user input doesn't match the option of the information related to the playing audio file, the procedure goes to step S307.

In step S307, the audio playing module 72 stops playing the audio file, randomly reads another audio file from the storage unit 5 and outputs it via the audio output unit 3, the procedure then goes to step S303.

In step S308, the recording module 75 adds 1 to the count number.

In step S309, the number confirming module 1006 determines whether the count number is equal to the preset number. If the count number is not equal to the preset number, the procedure returns to step 307; otherwise, the procedure goes to step S310.

In step S310, the managing unit 71 disables the alarm clock function, and resets the count number.

In addition, in other embodiments, in step S307, the audio playing module 72 continues playing the audio file, and in step S303, the option generating module 73 re-generates the preset number of options which are selected from other information related to the playing audio file.

Although the present invention has been specifically described on the basis of an exemplary embodiment thereof, the invention is not to be construed as being limited thereto. Various changes or modifications may be made to the embodiment without departing from the scope and spirit of the invention.

What is claimed is:

1. An electronic device with an alarm clock function, the electronic device comprising:

a storage unit storing an alarm time, audio files and related information;

an audio playing module for randomly playing an audio file via an audio output unit which matches the alarm time;

an option generating module for generating and outputting preset number options, at least one of them containing the related information of the playing audio file;

a comparison module for receiving inputs and determining whether the input matches the related information of the playing audio file;

a managing unit for disabling the alarm clock function when the input matches the related information.

2. The electronic device according to claim 1, wherein when the input does not match the related information of the playing audio file, the audio playing module stops playing the audio file, randomly reads another audio file from the storage unit, the option generating module re-generates preset number options, at least one of which comprises the related information of the playing audio file.

3. The electronic device according to claim 1, wherein when the input does not match the related information of the playing audio file, the audio playing module continues playing the audio file, the option generating module re-generates preset number options, at least one of which comprises the related information of the playing audio file.

4. The electronic device according to claim 1, wherein the storage unit further stores a preset number and a count number for indicating counts that the user input correctly, when the count number reaches the preset number, the audio playing module stop playing the audio file, and when the count number does not reach the preset number, the audio playing module randomly plays an audio file via an audio output unit.

5. The electronic device according to claim 1, wherein the option generating module also sends an icon together with each of the options, the comparison module compares whether the user's input matches with the icon.

6. A method of controlling an alarm clock function, the method comprising:

supplying a storage unit storing an alarm time, audio files and related information;

randomly playing an audio file via an audio output unit when the alarm time is coming;

generating and outputting preset number options, at least one of them containing the related information of the playing audio file;

receiving inputs and determining whether the input matches the related information of the playing audio file;

disabling the alarm clock function when the input matches the related information.

7. The method according to claim 6, wherein when the input does not match the related information of the playing audio file, stop playing the audio file, randomly reading another audio file from the storage unit, re-generating preset number options, at least one of which comprises the related information of the playing audio file.

8. The method according to claim 6, wherein when the input does not match the related information of the playing audio file, continue playing the audio file, re-generating preset number options, at least one of which comprises the related information of the playing audio file.

9. The method according to claim 6, wherein the storage unit further stores a preset number and a count number for indicating counts that the user input correctly, when the count number reaches the preset number, stop playing the audio file, and when the count number does not reach the preset number, randomly playing an audio file via an audio output unit.

10. The method according to claim 9, further comprising sending an icon together with each of the options, comparing whether the user's input matches with the icon.

* * * * *